US009861157B1

(12) United States Patent
Gair

(10) Patent No.: US 9,861,157 B1
(45) Date of Patent: Jan. 9, 2018

(54) SHOE COVERING

(71) Applicant: Anthony Gair, Iowa City, IA (US)

(72) Inventor: Anthony Gair, Iowa City, IA (US)

( * ) Notice: Subject to any disclaimer, the term of this patent is extended or adjusted under 35 U.S.C. 154(b) by 0 days.

(21) Appl. No.: 15/096,150

(22) Filed: Apr. 11, 2016

Related U.S. Application Data

(60) Provisional application No. 62/145,239, filed on Apr. 9, 2015.

(51) Int. Cl.
*A43B 5/18* (2006.01)
*A43B 3/18* (2006.01)

(52) U.S. Cl.
CPC ..... *A43B 3/18* (2013.01); *A43B 5/185* (2013.01)

(58) Field of Classification Search
CPC ..... A43B 3/16; A43B 5/18; A43B 5/185
USPC ..... 36/135
See application file for complete search history.

(56) References Cited

U.S. PATENT DOCUMENTS 3,313,047 A * 4/1967 Svien ..... A43B 5/18 36/135
4,872,273 A * 10/1989 Smeed ..... A43B 5/185 36/135
5,315,767 A * 5/1994 Bradbury ..... A43B 3/16 36/135
6,860,038 B1 * 3/2005 Stucke ..... A43B 5/185 36/135
2009/0288314 A1 * 11/2009 Kay ..... A43B 5/185 36/91

* cited by examiner

*Primary Examiner* — Ted Kavanaugh
(74) *Attorney, Agent, or Firm* — Hamilton IP Law, PC; Jay R. Hamilton; Charles Demschen

(57) ABSTRACT

A shoe covering may include an interior member and an exterior member. The interior member may be configured to be positioned adjacent a shoe outsole during use. The exterior member may be configured to be positioned adjacent a ground surface during use. The shoe covering may be configured such that it may be relatively easily engaged with/disengaged from a shoe. An aspect of the shoe covering may be configured to provide the user with increased traction, comfort, cushioning, and/or protection of spikes on the shoe as compared to use of a shoe without the shoe covering engaged with the shoe.

9 Claims, 13 Drawing Sheets

30a

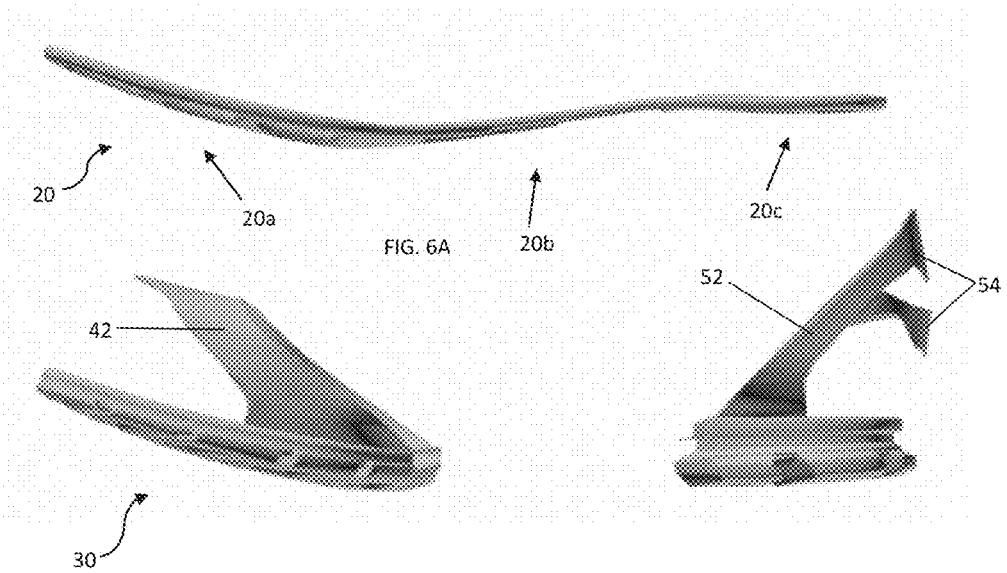
FIG. 6A
FIG. 6B
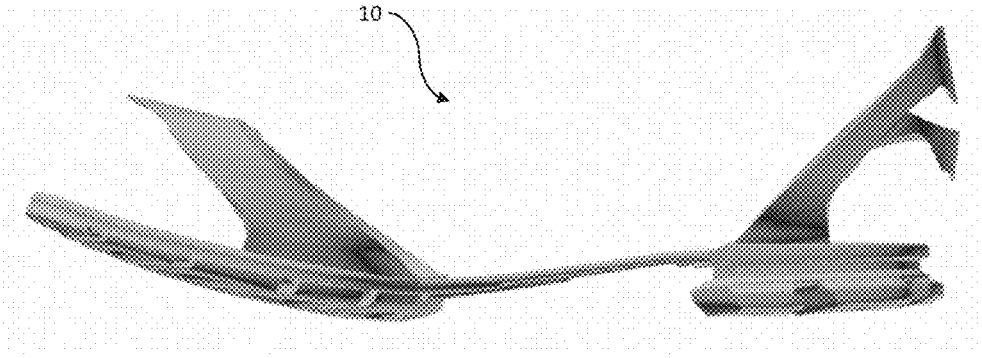
FIG. 6C

SHOE COVERING

CROSS REFERENCE TO RELATED APPLICATIONS

Applicant claims the filing benefit from provisional Pat. App. No. 62/145,239 filed on Apr. 9, 2015, which application is incorporated by reference herein in its entirety.

STATEMENT REGARDING FEDERALLY SPONSORED RESEARCH OR DEVELOPMENT

No federal funds were used to create or develop the invention herein.

REFERENCE TO SEQUENCE LISTING, A TABLE, OR A COMPUTER PROGRAM LISTING COMPACT DISK APPENDIX

N/A

BRIEF DESCRIPTION OF THE DRAWINGS

The accompanying drawings, which are incorporated in and constitute a part of this specification, illustrate embodiments and together with the description, serve to explain the principles of the shoe covering.

FIG. 6A provides a side view of the interior member from FIGS. 5A and 5C, wherein the interior member is separated from the exterior member.

FIG. 6B provides a side view of the exterior member from FIGS. 5B and 5C, wherein the exterior member is separated from the interior member.

FIG. 6C provides a side view of the interior member from FIG. 6A and the exterior member from FIG. 6B, wherein the interior member and exterior member are engaged with one another.

DETAILED DESCRIPTION ELEMENT LISTING

Figure 1A:
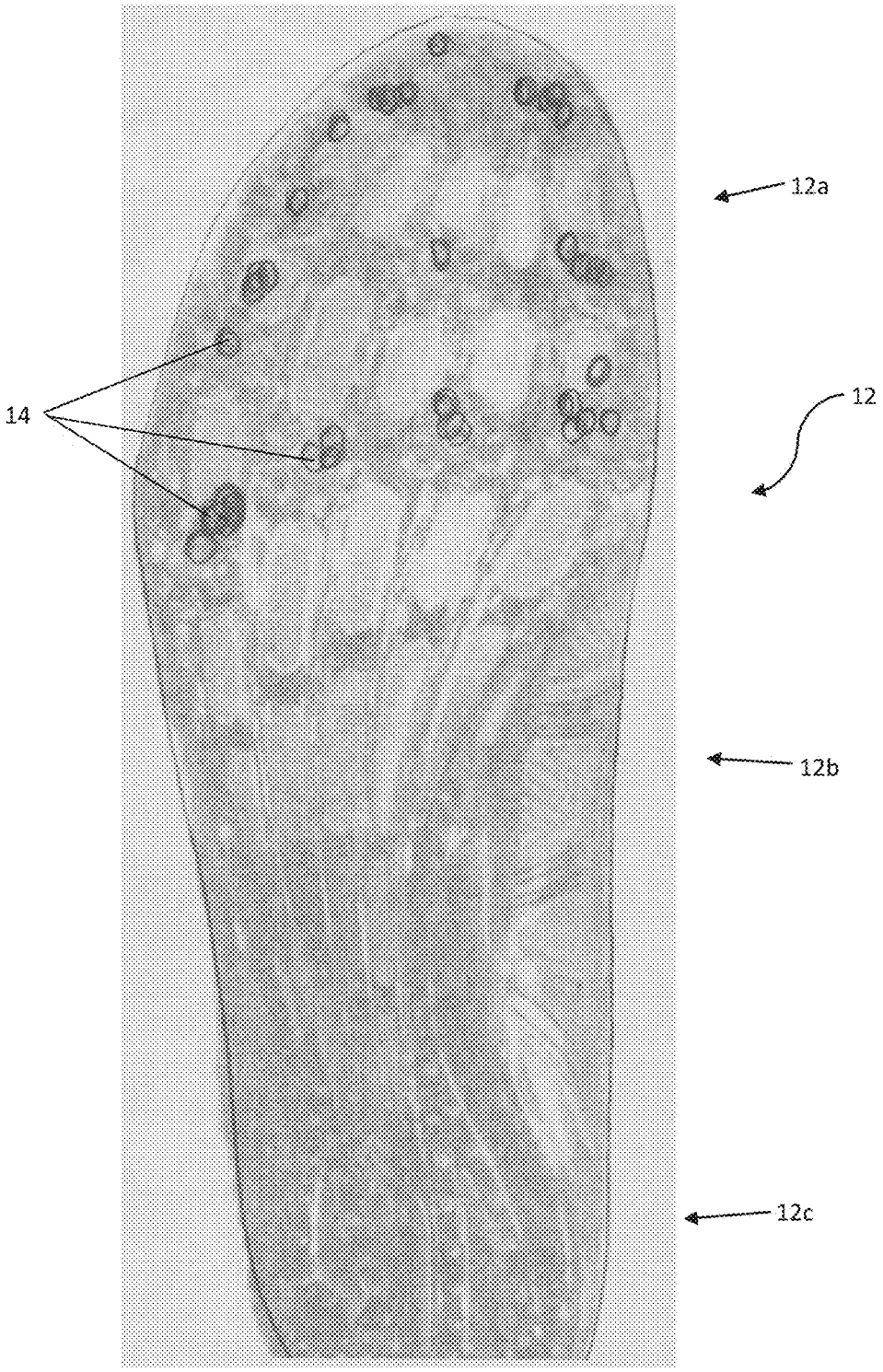
FIG. 1A provides a plane view of one illustrative embodiment of a shoe outsole showing several positions of spikes that may be positioned thereon.

| Description | Element No. |
|---|---|
| Shoe covering | 10 |
| Shoe | 11 |
| Shoe outsole | 12 |
| Toe | 12a |
| Arch | 12b |
| Heel | 12c |
| Spike | 14 |
| Interior member | 20 |
| Toe portion | 20a |
| Arch portion | 20b |
| Heel portion | 20c |
| Spike void | 22 |
| Elongated spike void | 22a |
| Middle spike void | 22c |
| Void | 23 |
| Bridge | 24 |
| Outsole contact surface | 26 |
| Bottom surface | 28 |
| Exterior member | 30 |
| Toe portion | 30a |
| Arch portion | 30b |
| Heel portion | 30c |
| Tread | 32 |
| Feature | 34 |
| Upper surface | 36 |
| Toe engagement member | 40 |
| Strap | 42 |
| Heel engagement member | 50 |
| Upper strap | 52 |
| Lateral strap | 54 |

DETAILED DESCRIPTION

Before the present shoe covering is disclosed and described, it is to be understood that the shoe covering is not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed shoe covering. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all shoe coverings. This applies to all aspects of this application including, but not limited to, components of a shoe covering. Thus, if there are a variety of additional components that can be added it is understood that each of these additional components can be added with any specific embodiment or combination of embodiments of the disclosed shoe covering 10.

The present shoe covering 10 may be understood more readily by reference to the following detailed description of preferred embodiments and the examples included therein and to the Figures and their previous and following description.

Figure 1B:
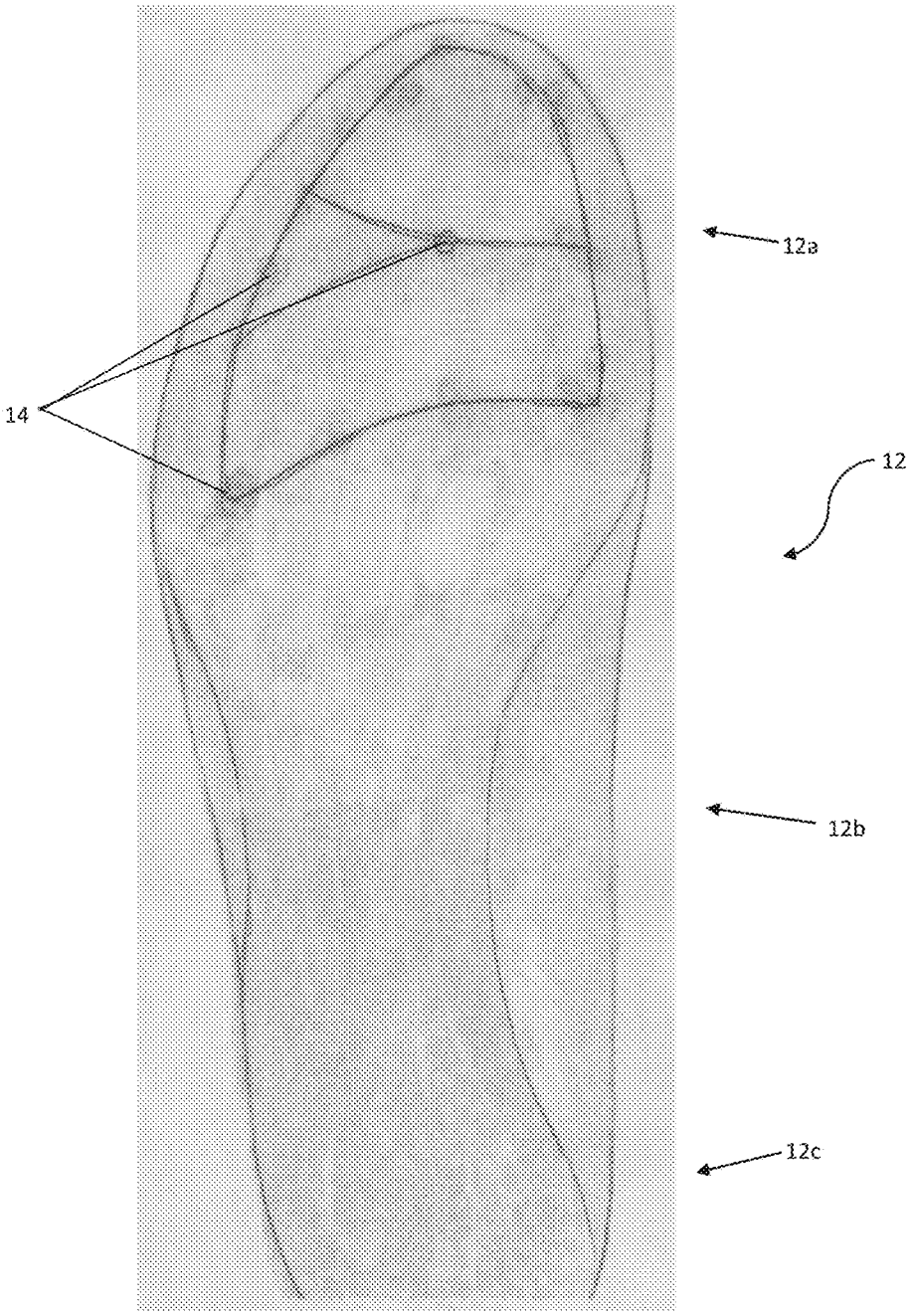
FIG. 1B provides a plane view of the illustrative embodiment of a shoe outsole with lines connecting various spikes positioned thereon.

A plane view of an illustrative embodiment of a shoe outsole 12 is shown in both FIGS. 1A and 1B. As shown, a shoe outsole 12 may be configured with a toe 12*a*, arch 12*b*, and heel 12*c*, wherein a plurality of spikes 14 may be positioned in and/or adjacent the toe 12*a*. The pattern, number, position, and/or configuration of the spikes may vary from one brand and/or embodiment of a shoe 11 to the next. As such, FIGS. 1A and 1B depict multiple spike 14 locations on the toe 12*a* so as to encompass various different brands and/or styles of shoes 11. Although some aspects of a shoe covering 10 pictured herein may be primarily useful with shoes 11 having spikes 14 positioned only on the toe 12*a* of the shoe outsole 12 (which shoes 11 may be commonly used for sprint, medium-distance, and/or long distance track races), the scope of the present disclosure is not so limited unless indicated in the following claims, and extends to any shoe 11 having spikes 14, cleats, and/or any other traction-increasing element on the shoe outsole 12 at the toe 12*a*, arch 12*b*, and/or heel 12*c*.

Figure 4A:
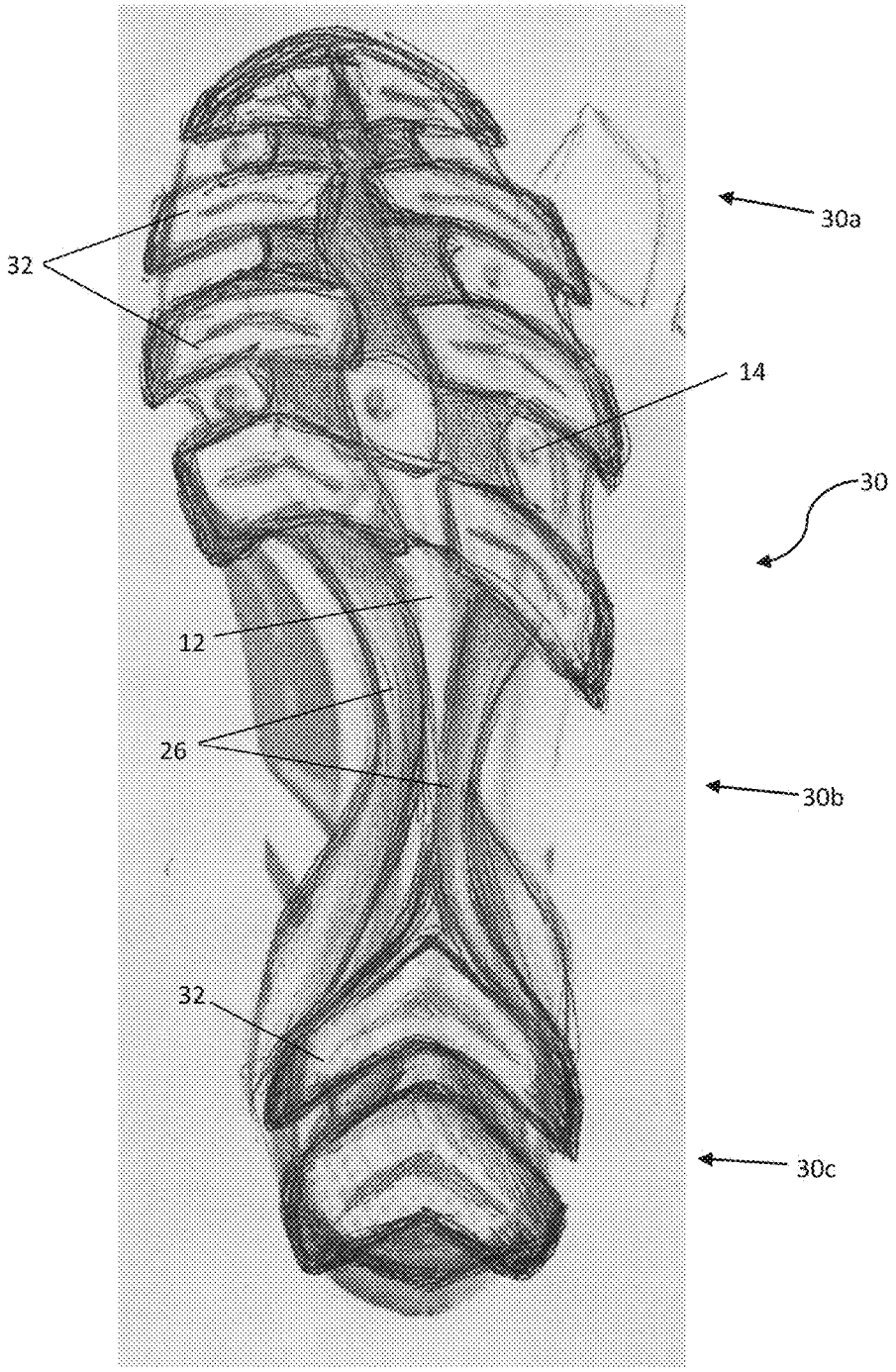
FIG. 4A provides a bottom view of the outer surface of some aspects of a shoe covering engaged with a shoe.
Figure 4B:
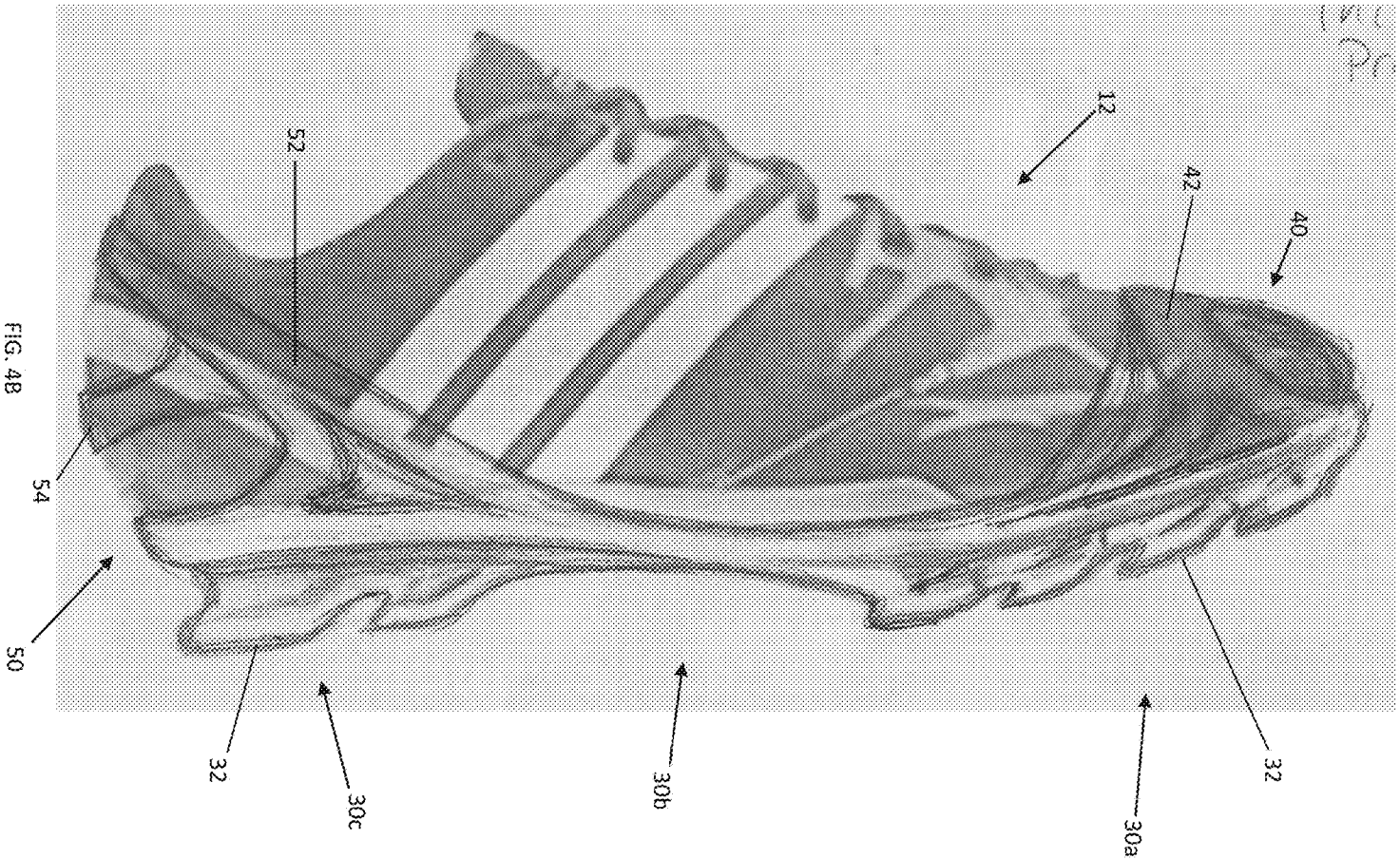
FIG. 4B provides a side view of the shoe covering from FIG. 4A engaged with a shoe.
Figures 5A, 5B:
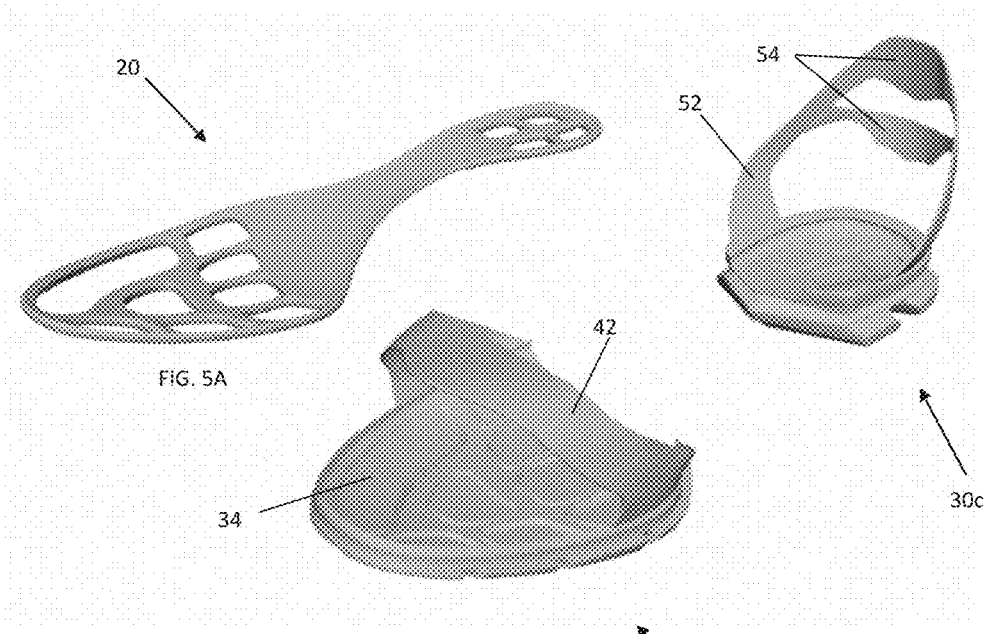
FIG. 5A provides a perspective view of various aspects of an interior member of a shoe covering separated from an exterior member thereof.
FIG. 5B provides a perspective view of various aspects of an exterior member of a shoe covering corresponding to the interior member show in FIG. 5A.
Figure 5C:
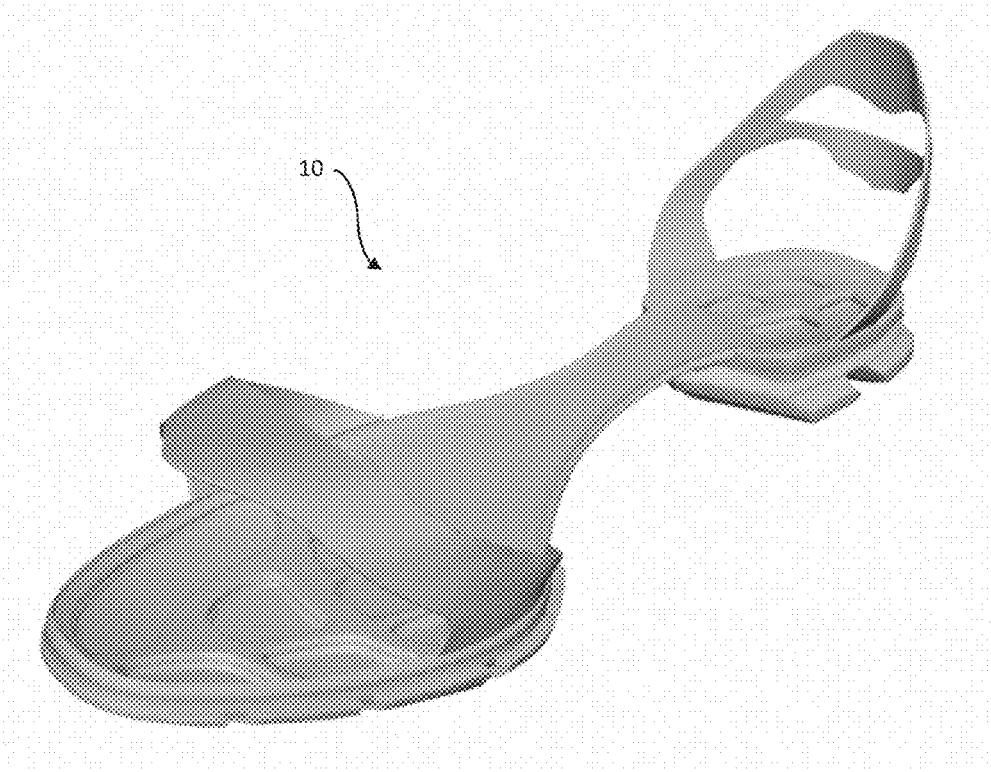
FIG. 5C provides a perspective view of the interior member from FIG. 5A and the exterior member from FIG. 5B, wherein the interior member and exterior member are engaged with one another.

Generally, the shoe covering 10 may be positioned over a portion of a shoe 11 as shown for certain aspects of a shoe covering 10 and one embodiment of a shoe 12 in FIGS. 4A and 4B. It is contemplated that in an aspect of the shoe covering 10, the shoe covering 10 may engage a shoe 12 securely enough so that a user may use the shoe 12 when the shoe covering 10 is engaged with the shoe 12 for various activities including but not limited to, walking, stretching, running, aerobic exercises, and/or other warm-up and/or cool-down activities without limitation unless so indicated in the following claims. It is contemplated that in an aspect of the shoe covering 10 the shoe covering 10 will provide the user with increased traction, comfort, and/or cushioning compared to use of the shoe 12 without the shoe covering 10. Additionally, the shoe covering 10 may protect the spikes 14 and thereby increase the longevity thereof.

Various aspects of a shoe covering are shown in FIGS. 5A-8C. Generally, this shoe covering 10 may include an interior member 20 and an exterior member 30. The interior and exterior members 20, 30 may be engaged with one another such that they comprise one unitary structure. Any method and/or structure suitable for the specific application of the shoe covering 10 may be used to engage the interior member 20 with the exterior member 30, including but not limited to mechanical fasteners (rivets, pins, screws, etc.), chemical adhesives, chemical bonding, polymer castings, etc.

It is contemplated that in the shoe covering 10 shown in FIGS. 5A-8C the interior member 20 may be constructed of, but not limited to unless so indicated in the following claims, Kevlar®, carbon fiber, foam-blown polyurethane, thermoplastic polyurethane, ethylene vinyl acetate, other polymers, other thermoplastics, carbon rubber, blown rubber polymers, composite materials, natural materials (e.g., rubber, leather, etc.), elastomers, combinations thereof, and/or any other material with suitable characteristics (e.g., stability, elasticity, density). In an aspect, the interior member 20 may be constructed of the same or similar material to that of the shoe outsole 12.

It is contemplated that in the shoe covering 10 shown in FIGS. 5A-8C the exterior member 30 may be constructed of, but not limited to unless so indicated in the following claims, Kevlar®, carbon fiber, foam-blown polyurethane, thermoplastic polyurethane, ethylene vinyl acetate, other polymers, other thermoplastics, carbon rubber, blown rubber polymers, composite materials, natural materials (e.g., rubber, leather, etc.), elastomers, combinations thereof, and/or any other material with suitable characteristics (e.g., stability, elasticity, density). In an aspect, the exterior member 30 may be constructed of the same or similar material to that of the shoe outsole 12, or it may be constructed of a material that provides increased traction, comfort, and/or cushioning compared to that of the shoe outsole 12.

In one aspect of the shoe covering 10, the interior member 20 and exterior member 30 may be manufactured as one integral component such that the interior member 20 and exterior member 30 may be engaged with one another during the manufacturing process and/or such that the demarcation between the interior and exterior members 20, 30 is not easily detected. Manufacturing methods for such an aspect of a shoe covering 10 may include but are not limited to thermoforming, extrusion, blow molding, and/or thermocasting.

Figure 7A:
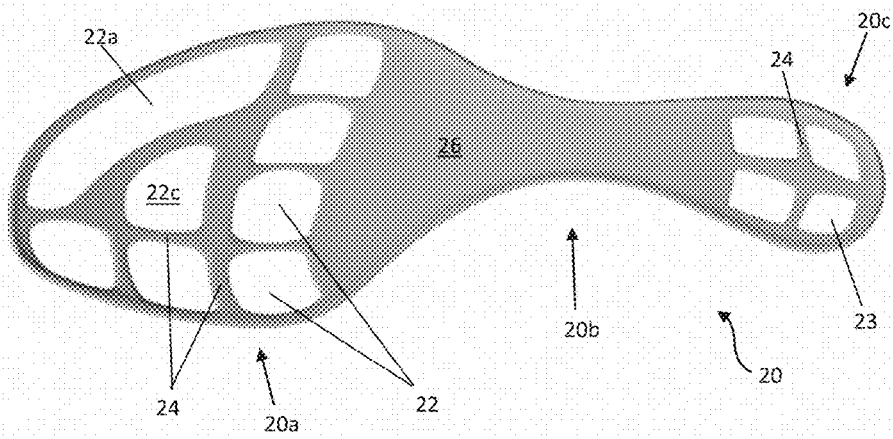
FIG. 7A provides a top view of the interior member from FIGS. 5A and 6A, wherein the interior member is separated from the exterior member.
Figure 7B:
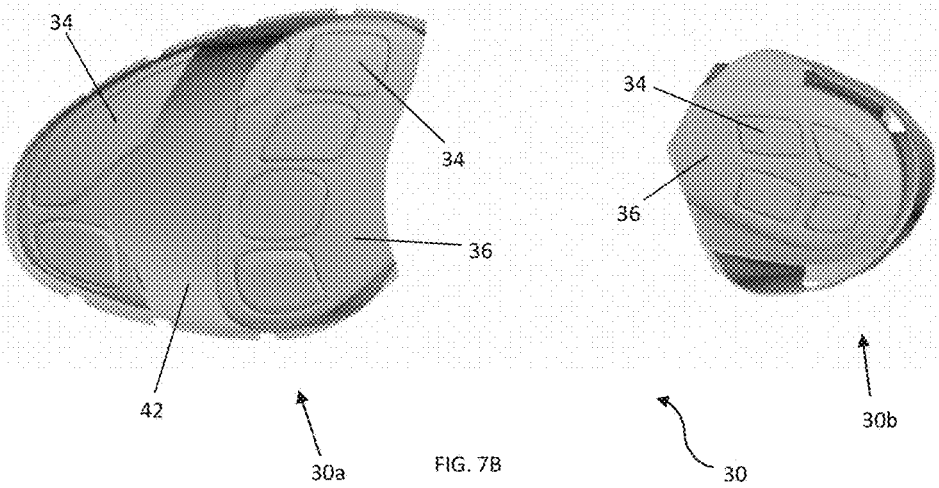
FIG. 7B provides a top view of the exterior member from FIGS. 5B and 6B, wherein the exterior member is separated from the interior member.
Figure 7C:
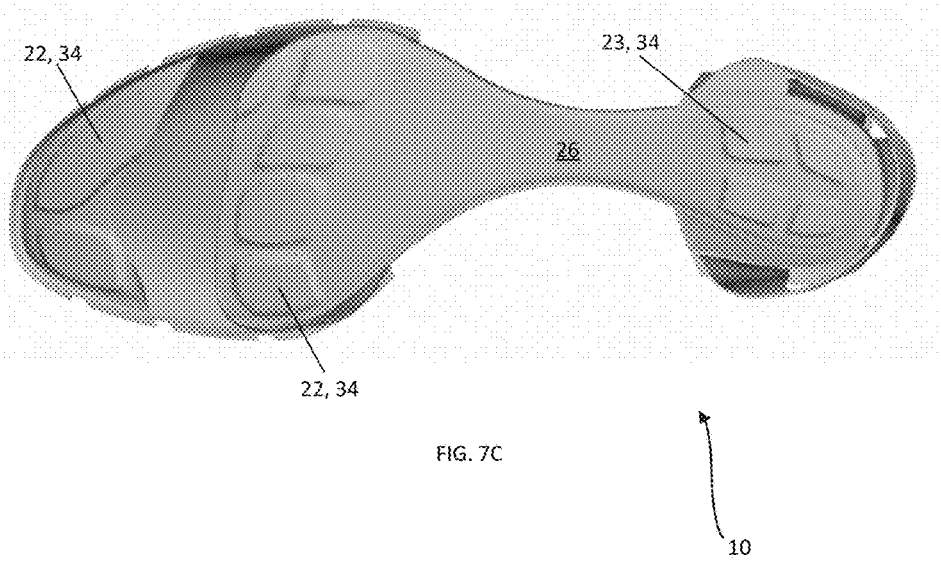
FIG. 7C provides a top view of the interior member from FIG. 7A and the exterior member from FIG. 7B, wherein the interior member and exterior member are engaged with one another.

Referring now to FIGS. 7A, 7B, and 7C, which provide top view of the interior member 20 and exterior member 30 separated and engaged with one another, respectively, the interior member 20 may include a toe portion 20*a*, arch portion 20*b*, and heel portion 20*c*, each of which may correspond to a toe 12*a*, arch 12*b*, and heel 12*c* of a shoe outsole 12. It is contemplated that during use of some embodiments of a shoe covering 10, the interior member 20 may be positioned adjacent the shoe outsole 12 and the exterior member 30 may be positioned below the interior member 20 such that the exterior member 30 may contact the ground surface during use. Accordingly, one surface of the interior member 20 may constitute an outsole contact surface 26 and the opposite surface thereof may constitute a bottom surface 28, which bottom surface 28 may contact the exterior member 30 during use as explained in further detail below.

The interior member 20 may be formed with one or more spike voids 22 in the toe portion 20*a* and one or more voids 23 in the heel portion 20*c*. The spike voids 22 and/or voids 23 may be separated from one another via one or more bridges 24. The spike voids 22 and bridges 24 of the toe portion 20*a* may be configured to accommodate a plurality of spike 14 patterns in a shoe outsole 12 such that one shoe covering 10 may be used with multiple different types and/or brands of shoes 11.

In an aspect and referring to FIG. 7A, the interior member 20 may be formed with four spike voids 22 along the major width of the toe portion 20*a*. On the outside edge of the toe portion 20*a*, the interior member 20 may be formed with an elongated spike void 22*a*, having two smaller spike voids 22 between the elongated spike void 22*a* and the inner edge of the interior member 20. The most interior spike void 22, or middle spike void 22*c*, may include an angled portion thereon immediately adjacent the bridge 24 between the middle spike void 22*c* and the elongated spike void 22*a*. Finally, another generally smaller spike void 22 may be positioned adjacent the end of the elongated spike void 22*a* at the distal end of the toe portion 20*a* of the interior member 20. Some of the bridges 24 may be thicker and/or wider than other bridges. Still referring to FIG. 7A, the bridge along the interior side of the elongated spike void 22*a* may be wider than the voids 22 between adjacent spike voids 22 generally positioned across the major width of the interior member 20. The heel portion 20*c* may be formed with four voids 23 generally configured in a square pattern, wherein the bridges 24 separating the void 23 may generally form a cross. Accordingly, the specific pattern, dimensions, and/or configuration of the spike voids 22, voids 23, and/or bridges 24 in the toe portion 20*a* and/or heel portion 20*c* of the interior member 20 in no way limit the scope of the shoe covering 10 unless so indicated in the following claims.

Figure 2:
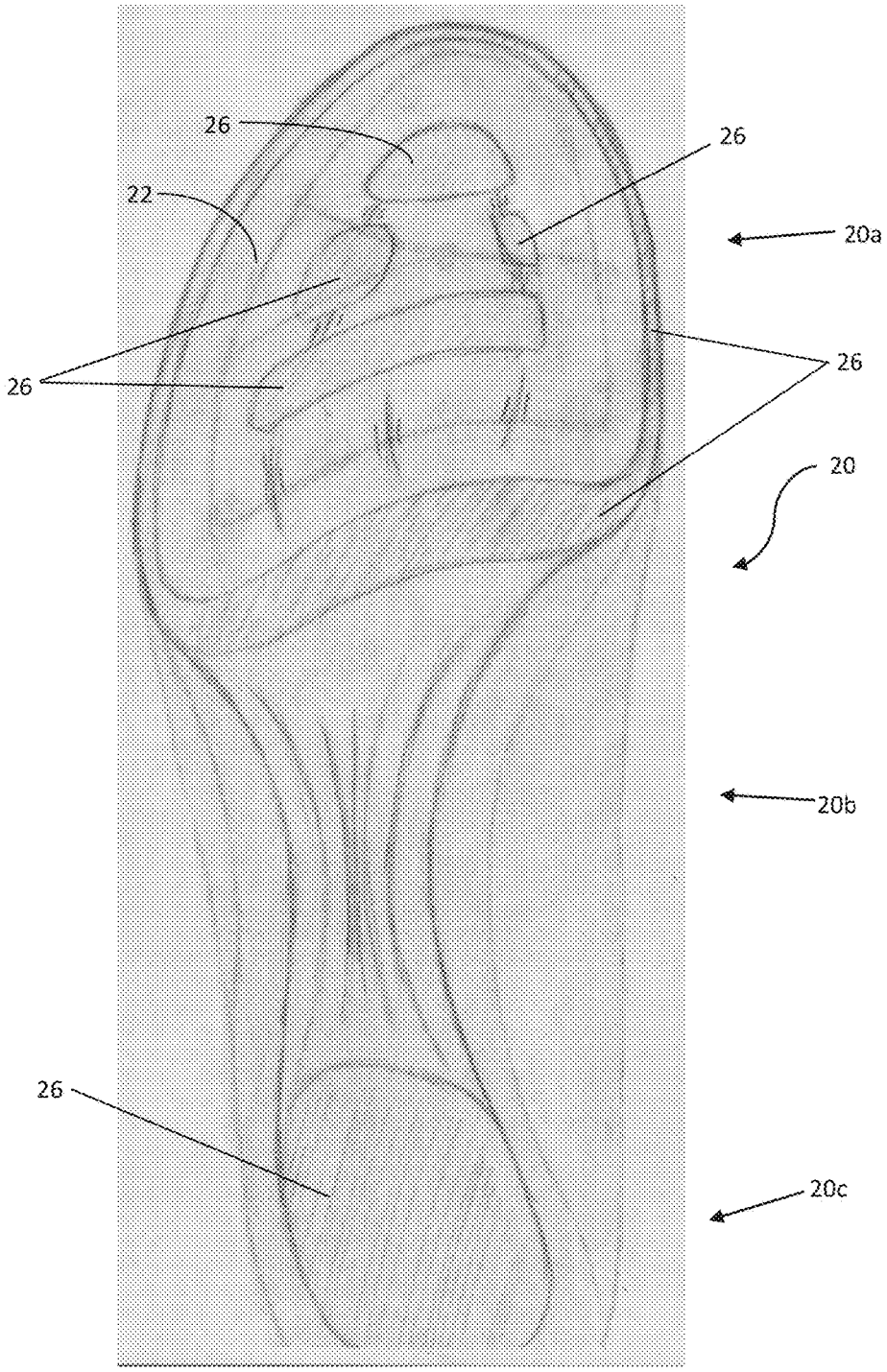
FIG. 2 provides a plane view of various aspects of an interior member that may be configured for use with the shoe covering disclosed herein.
Figure 3:
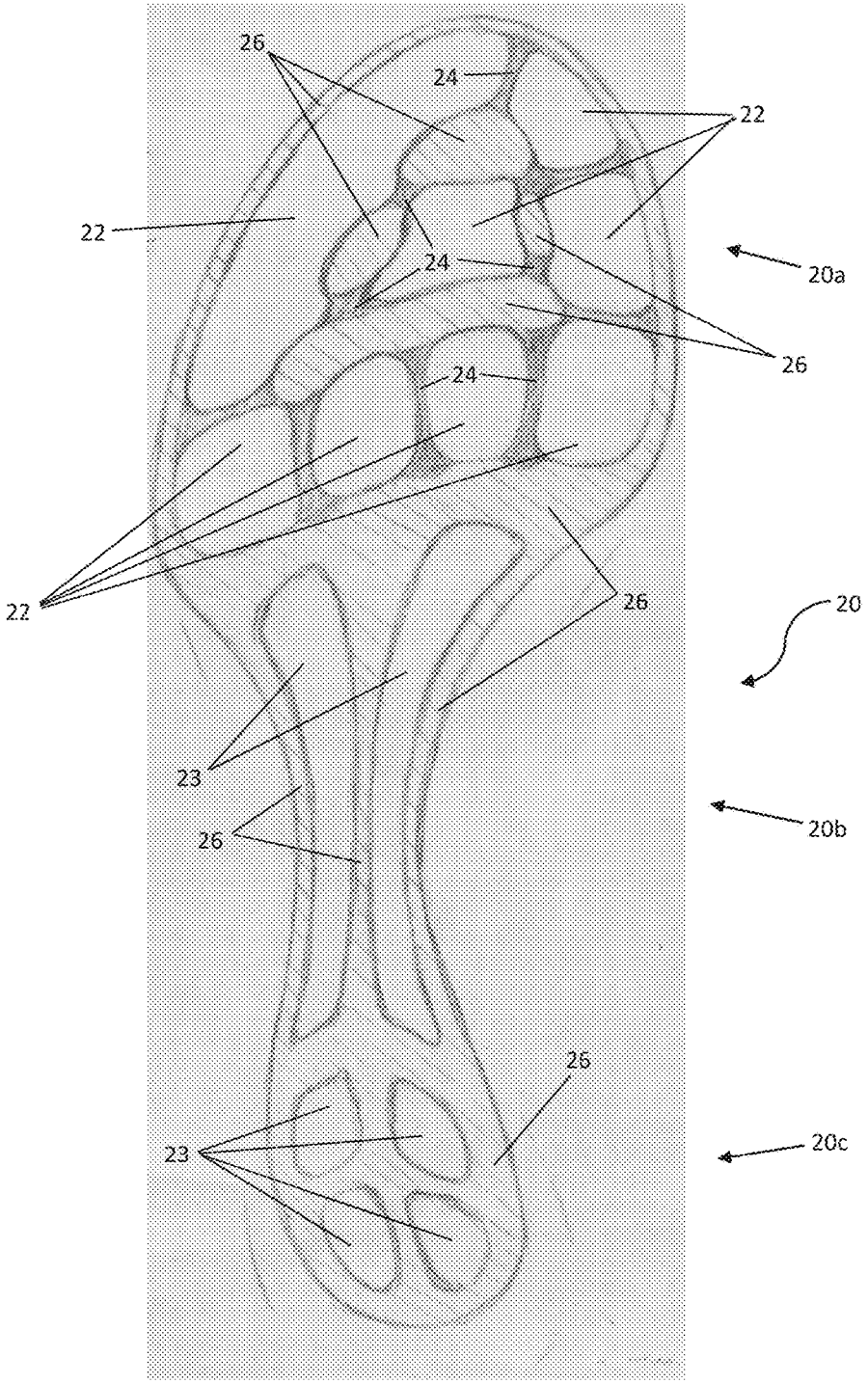
FIG. 3 provides a plane view of other aspects of an interior member that may be configured for use with various the shoe covering disclosed herein.

Other aspects of an interior member 20 are shown in FIG. 2, and still further aspects of an interior member 20 are shown in FIG. 3. As shown in FIG. 2, the heel portion 20*c* may be formed without any voids 23 and/or spike voids 22. Additionally, the arch portion 20*b* may be formed with one or more voids 23, as shown in FIG. 3. It is contemplated that an arch portion 20*b* having a void 23 may have reduced weight compared to an arch portion 20*b* without any voids 23. Again, the various dimensions, relative locations, configurations, etc. of the spike voids 22, voids 23, outsole contact surfaces 26, and/or bridges 24 may vary from one aspect of the shoe covering 10 to the next, and are therefore in no way limited to the scope of the shoe covering 10 unless so indicated in the following claims.

Again referring to FIGS. 7A-7B, the exterior member 30 may include a toe portion 30*a* and a heel portion 30*c*, both of which may correspond to the toe portion 20*a* and heel portion 20*c* in the interior member 20, and consequently, the toe 12*a* and heel 12*c* of a shoe outsole 12. Again, it is contemplated that during use of the shoe covering 10, an upper surface 36 of the exterior member 30 may abut the bottom surface 28 of the interior member 20. The upper surface 36 of the exterior member 30 may be formed with one or more features 34 therein (in the toe portion 30*a* and/or heel portion 30*b*), which features 34 may correspond to the spike voids 22 and/or voids 23 formed in the interior member 20 in size, shape, orientation, etc. as evident from the various figures herein. In an aspect, each feature 34 may be configured as a cavity. However, in another aspect each feature 34 may be configured as a raised portion. In such an aspect, a portion of each feature 34 may pass through the corresponding spike void 22 and/or void 23. It is contemplated that this may provide an enhanced degree of engagement between the interior and exterior members 20, 30 to mitigate unwanted slippage therebetween. However, as with the interior member 20, the specific pattern, dimensions, and/or configuration of the features 34 in the toe portion 30*a* and/or heel portion 30*c* of the exterior member 30 in no way limit the scope of the shoe covering 10 unless so indicated in the following claims.

Generally, the embodiment of an exterior member 30 shown in FIGS. 5A-8C may be comprised of a toe portion 30*a* and a heel portion 30*c* (without a corresponding arch portion 30*b* of the exterior member 30), wherein the toe and heel portions 30*a*, 30*c* of the exterior member 30 may be properly located via the engagement between the interior member 20 and the exterior member 30. Accordingly, as shown in FIG. 8B, which provides a bottom plane view of an illustrative embodiment of the shoe covering 10, the bottom surface 28 of the interior member 20 at the arch portion 20*b* thereof may be exposed to a ground surface during use of a shoe 12 having a shoe covering 10 engaged therewith.

Figure 8A:
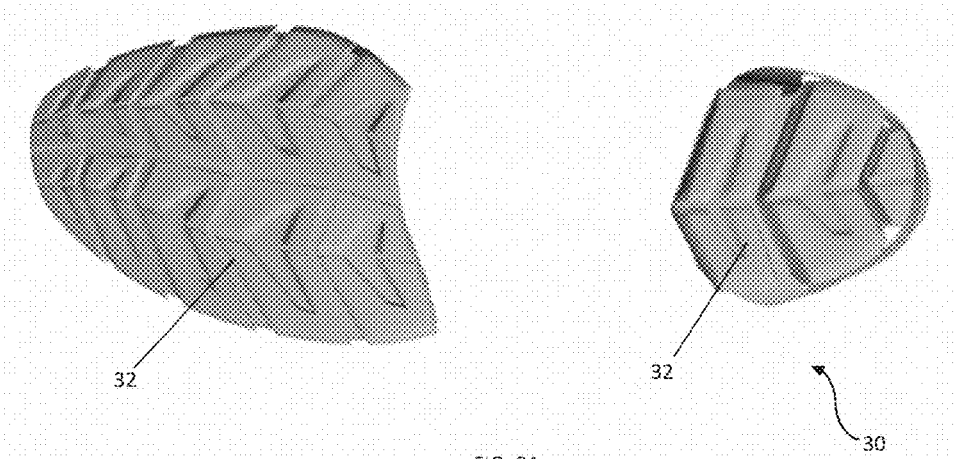
FIG. 8A provides a bottom view of the interior member from FIGS. 5A, 6A, and 7A, wherein the interior member is separated from the exterior member.
Figure 8B:
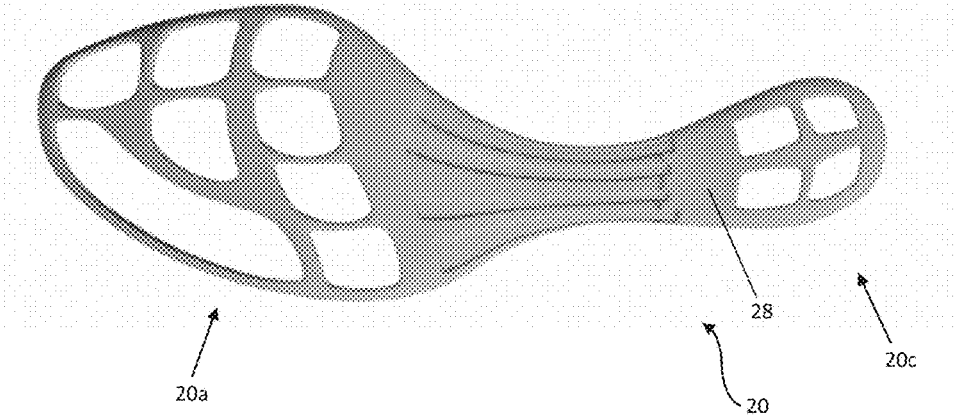
FIG. 8B provides a bottom view of the exterior member from FIGS. 5B, 6B, and 7B, wherein the exterior member is separated from the interior member.
Figure 8C:
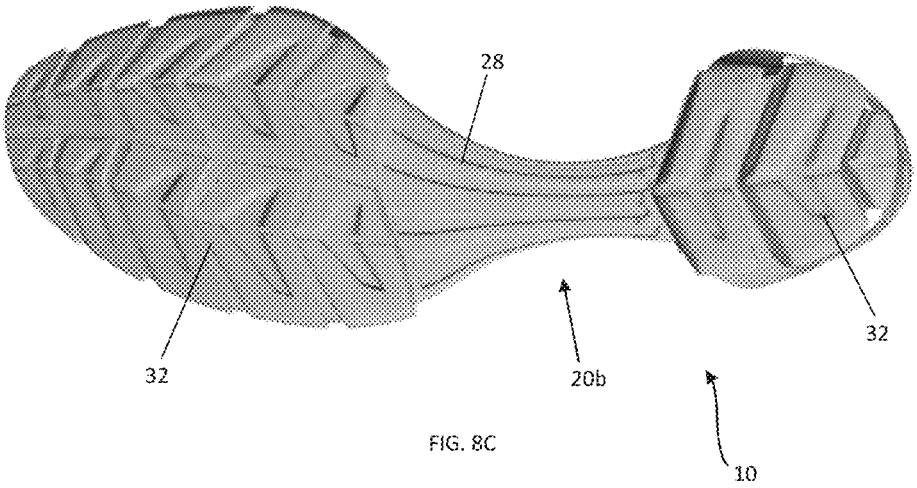
FIG. 8C provides a bottom view of the interior member from FIG. 8A and the exterior member from FIG. 8B, wherein the interior member and exterior member are engaged with one another.

A tread 32 may be positioned on the surface of the exterior member 30 that is opposite the upper surface 36 of the exterior member 30, and which tread 32 may be configured to serve as the ground-engaging surface during use of a shoe 12 having a shoe covering 10 engaged therewith. As shown in FIG. 8A, the tread 32 may be formed with two rows of progressive, generally chevron-shaped cutouts in the toe portion 30*a*, with angular cutouts longitudinally positioned between pairs for chevrons in the two rows. The heal portion 30*b* may be formed with generally chevron-shaped cutouts and one or more angular cutouts therebetween and/or adjacent thereto. It is contemplated that the angular cutouts may aide with flexibility of the toe portion 30*a* of the exterior member 30 and the chevron cutouts may aide in grip and/or traction of the exterior member 30. The specific pattern, grooves, dimensions, configuration, etc. of the features of the tread 32 may vary from one embodiment of the exterior member 30 to the next and are therefore in no way limiting to the scope of the shoe covering 10 unless so indicated in the following claims.

A toe engagement member 40 may be positioned such that it corresponds to the toe portions 20*a*, 30*a* of both the interior member 20 and the exterior member 30. In the shoe cover 10 shown in FIGS. 5A-8C, the toe engagement member 40 may be integrally formed with the toe portion 30*a* of the exterior member 30. However, in other aspects of the shoe covering 10 the toe engagement member 40 may be integrally formed with the interior member 20, or the toe engagement member 40 may be separately formed from either the interior member 20 or exterior member 30 and then later engaged with one or both the interior and/or exterior members 20, 30 without limitation unless so indicated in the following claims.

In the shoe covering 10 shown in FIGS. 5A-8C, the toe engagement member 40 primarily may comprise a strap 42 configured such that the toe portion of a shoe 11 may be positioned between the strap 42 and the toe portions 20*a*, 30*a* of the interior and exterior members 20, 30 as depicted in FIGS. 4A and 4B for an illustrative embodiment of a shoe 11 engaged with a shoe covering 10. The toe engagement member 40 may be configured such that it may provide proper engagement of the shoe covering 10 with a variety of shoes 11 adjacent the toe of the shoe 11. Accordingly, the specific dimensions, configuration, and/or other features of the toe engagement member 40 may vary from one embodiment of the shoe covering 10 to the next, and are therefore in no way limiting to the scope of the present disclosure unless so indicated in the following claims.

A heel engagement member 50 may be positioned such that it corresponds to the heel portions 20*c*, 30*c* of both the interior member 20 and the exterior member 30. In the shoe covering shown in FIGS. 5A-8C, the heel engagement member 50 may be integrally formed with the heel portion 30*c* of the exterior member 30. However, in other aspects of the shoe covering 10 the heel engagement member 50 may be integrally formed with the interior member 20, or the heel engagement member 50 may be separately formed from either the interior member 20 or exterior member 30 and then later engaged with one or both the interior and/or exterior members 20, 30 without limitation unless so indicated in the following claims.

In the shoe covering 10 shown in FIGS. 5A-8C, the heel engagement member 50 primarily may comprise an upper strap 52 extending upward and at least one lateral strap 54 (two lateral straps 54 are shown for the shoe covering 10 in FIGS. 5A-8C), which lateral straps 54 may span the back of the heel of a shoe 11 when the shoe covering 10 is engaged with a shoe 11. The heel engagement member 50 may be configured such that the heel portion of a shoe 11 may be positioned within the heel engagement member 50 as depicted in FIGS. 4A and 4B for an illustrative embodiment of a shoe 11 engaged with a shoe covering 10. The heel engagement member 50 may be configured such that it may provide proper engagement of the shoe covering 10 with a variety of shoes 11 adjacent the heel. Accordingly, the specific dimensions, configuration, and/or other features of the heel engagement member 50 may vary from one embodiment of the shoe covering 10 to the next, and are therefore in no way limiting to the scope of the present disclosure unless so indicated in the following claims.

To facilitate relatively easy ingress/egress of a shoe 11 to the toe engagement member 40 and/or heel engagement member 50, the various components of the toe engagement member 40 and/or heel engagement member 50 (e.g., strap 42, upper strap 52, lateral strap 54, etc.) may be constructed of a material that is at least somewhat flexible and/or elastic. Additionally, it is contemplated that in an aspect of the shoe covering 10, constructing the arch portion 20*b* of the interior member 20 of a material that is generally flexible and/or at least somewhat stretchable and/or elastic may also facilitate relatively easy engagement/disengagement of a shoe 11 with the shoe covering 10. Such a configuration may also allow for a shoe covering 10 with a given set of dimensions and/or configurations may be properly engaged various brands, sizes, ranges of sizes, and/or types of shoes 11.

In an aspect of the shoe covering 10, the exterior member 30 may be configured with an arch portion 30*b*, although the illustrative embodiment shown in FIGS. 5A-8C is not so configured. In an aspect of the shoe covering 10, the length of the arch portions 20*b*, 30*b* of either the interior or exterior members 20, 30 may have a length that is adjustable so as to accommodate an even larger variety of brands, sizes, ranges of sizes, and/or types of shoes 12. Any suitable structure and/or method may be used to provide the desired adjustability of length, including but not limited to elastic or semi-elastic materials of construction, mechanical adjusters (e.g., tooth-and-notch connectors), and/or combinations thereof without limitation unless so indicated in the following claims.

The various elements of the shoe covering 10 may be separately formed and later engaged with one another (e.g., via mechanical fasteners, material fusing, chemical adhesives, etc.) or integrally formed with one another. The materials used to construct the shoe covering 10 and various elements thereof will vary depending on at least the specific application of the shoe covering 10, but it is contemplated that synthetic polymers, other synthetic materials, natural materials, and/or combinations thereof will be especially useful for some applications. Accordingly, the above-referenced elements may be constructed of any material known to those skilled in the art or later developed, which material is appropriate for the specific application of the shoe covering 10, without departing from the spirit and scope of the shoe covering 10 as disclosed herein unless so indicated in the following claims.

Having described the preferred embodiments, other features of the shoe covering 10 will undoubtedly occur to those versed in the art, as will numerous modifications and alterations in the embodiments as illustrated herein, all of which may be achieved without departing from the spirit and scope of the shoe covering 10 disclosed herein. Accordingly, the methods and embodiments pictured and described herein are for illustrative purposes only, and the scope of the present disclosure extends to all method and/or structures for providing increased functionality, comfort, and/or longevity to shoes and/or components thereof. Furthermore, the methods and embodiments pictured and described herein are no way limiting to the scope of the shoe covering 10 unless so stated in the following claims.

It should be noted that the shoe covering 10 is not limited to the specific embodiments pictured and described herein, but is intended to apply to all similar apparatuses and methods for providing the various benefits and/or features of a shoe covering 10. It is understood that the shoe covering 10 as disclosed herein extends to all alternative combinations of one or more of the individual features mentioned, evident from the text and/or drawings, and/or inherently disclosed. All of these different combinations constitute various alternative aspects of the shoe covering 10 and/or components thereof. The embodiments described herein explain the best modes known for practicing the shoe covering 10 and/or components thereof and will enable others skilled in the art to utilize the same. The claims are to be construed to include alternative embodiments to the extent permitted by the prior art.

While the shoe covering 10 has been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as illustrative only, with a true scope and spirit being indicated by the following claims.

What is claimed is:

1. A shoe covering comprising:

a. an interior member having an outsole contact surface and a bottom surface opposite one another, said interior member comprising:

i. a toe portion having a first spike void and a second spike void positioned therein and a bridge positioned between and separating said first spike void and said second spike void;

ii. a heel portion having a first void and a second void positioned therein and a second bridge positioned between and separating said first void and said second void; and, iii. an arch portion connecting said toe portion and said heel portion;

b. an exterior member having an upper surface and a tread, wherein said upper surface of said exterior member is directly engaged with said bottom surface of said interior member, said exterior member comprising:

i. a toe portion corresponding to said toe portion of said interior member, wherein said toe portion has a first feature corresponding to said first spike void and a second feature corresponding to said second spike void, wherein a toe engagement member extends upward from a first edge of said toe portion laterally across said toe portion to a second edge thereof, wherein said toe engagement member is configured to engage a toe of a shoe; and, ii. a heel portion corresponding to said heel portion of said interior member, wherein said heel portion has a first feature corresponding to said first void and a second feature corresponding to said second void, wherein a heel engagement member extends upward from said heel portion and is configured for engaging a heel of said shoe.

2. The shoe covering according to claim 1 wherein said shoe is further defined as having an outsole with a spike positioned therein.

3. The shoe covering according to claim 2 wherein said heel engagement member is further defined as comprising an upper strap and a lateral strap, wherein said lateral strap is positioned below said upper strap.

4. The shoe covering according to claim 3 wherein said interior member is further defined as comprising an elongated spike void in said toe portion.

5. The shoe covering according to claim 4 wherein said interior member is further defined as comprising a middle spike void in said toe portion.

6. A method of using a shoe cover comprising:

a. protecting a spike on a toe of an outsole of a shoe by engaging a shoe covering with said shoe, said shoe covering comprising:

i. an interior member having an outsole contact surface and a bottom surface opposite one another, said interior member comprising:

1. a toe portion having a first spike void and a second spike void positioned therein and a bridge positioned between and separating said first spike void and said second spike void;

2. a heel portion having a first void and a second void positioned therein and a second bridge positioned between and separating said first void and said second void; and, 3. an arch portion connecting said toe portion and said heel portion;

ii. an exterior member having an upper surface and a tread, wherein said upper surface of said exterior member is directly engaged with said bottom surface of said interior member, said exterior member comprising:

1. a toe portion corresponding to said toe portion of said interior member, wherein said toe portion has a first feature corresponding to said first spike void and a second feature corresponding to said second spike void, wherein a toe engagement member extends upward from a first edge of said toe portion laterally across said toe portion to a second edge thereof, wherein said toe engagement member is configured to engage a toe of a shoe; and, 2. a heel portion corresponding to said heel portion of said interior member, wherein said heel portion has a first feature corresponding to said first void and a second feature corresponding to said second void, wherein a heel engagement member extends upward from said heel portion and is configured for engaging a heel of said shoe;

b. placing said toe of said shoe between said outsole contact surface of said interior member and said toe engagement member;

c. positioning said toe of said shoe such that said spike passes through said spike void in said interior member and contacts said first feature of said toe portion of said exterior member;

d. stretching said arch portion of said interior member away from said toe portion; and, e. placing a heel of said shoe between said outsole contact surface of said interior member and said heel engagement member.

7. The method according to claim 6 wherein said heel engagement member is further defined as comprising an upper strap and a lateral strap, wherein said lateral strap is positioned below said upper strap.

8. The method according to claim 7 wherein said interior member is further defined as comprising an elongated spike void in said toe portion.

9. The method according to claim 8 wherein said interior member is further defined as comprising a middle spike void in said toe portion.

* * * * *